United States Patent [19]

Roberts et al.

[11] Patent Number: 4,618,200

[45] Date of Patent: Oct. 21, 1986

[54] ELECTRICAL PLUG RESTRAINT SYSTEM

[76] Inventors: David Roberts, 36 Dixon Avenue, Toronto, Ontario, Canada, M4L 1N3; Clyde Hillier, 324 Connington, London, Ontario, Canada, N6C 4C9

[21] Appl. No.: 705,113

[22] Filed: Feb. 22, 1985

[51] Int. Cl.[4] ..... H01R 13/631

[52] U.S. Cl. ..... 339/75 P; 339/103 R

[58] Field of Search ..... 339/75 P, 103 R

[56] References Cited

U.S. PATENT DOCUMENTS

| | | | |
|---|---|---|---|
| 3,538,484 | 11/1970 | Passafiume | 339/75 P |
| 3,811,104 | 5/1974 | Caldwell | 339/75 P |
| 4,066,313 | 1/1978 | von dem Hagen | 339/75 P |
| 4,083,618 | 4/1978 | Busch, Jr. | 339/75 P |
| 4,105,274 | 8/1978 | Casey | 339/103 R |

FOREIGN PATENT DOCUMENTS

| | | | |
|---|---|---|---|
| 1152176 | 8/1983 | Canada | 339/75 P |

*Primary Examiner*—John McQuade

[57] ABSTRACT

The present application discloses a new electrical plug restraint system for use with duplex wall receptacles. The system secures a post like member to the receptacle and a cover is releasably maintained by the post with electrical plugs generally interior to the cover. The cover is releasable from the post in a manner difficult for a child to remove, to reduce possibility of tampering by the child.

11 Claims, 6 Drawing Figures

ELECTRICAL PLUG RESTRAINT SYSTEM

The present invention relates to electrical plug restraint systems for use with the common duplex wall receptacles. In particular, the invention is related to electrical plug restraint systems which require removal of a cover component to allow an electrical plug to be removed or inserted in a wall receptacle.

The problems associated with wall receptacles and particular, the danger these wall receptacles present to small children has initiated the marketing of a number of different systems to reduce this danger. For example, U.S. Pat. No. 4,045,108 which issued to Olsen, Oct. 30, 1977, discloses a plug restraint system which has paired flanges extending outwardly from a centrally secured portion which flanges are adapted to contact the rear of the plug and hold the same in the inserted position in the associated socket. These flanges act as spring legs which may be manually flexed to allow insertion or removal of the plug, however, the pressure created thereby is sufficient to prevent inadvertent withdrawl or withdrawl by a small child. A similar type structure is disclosed in U.S. Pat. No. 4,105,274 which issued to Casey, Aug. 8, 1978. A further system is shown in U.S. Pat. No. 2,659,059, which issued to Johnson, Nov. 10, 1953.

These systems satisfactorily retain the plug in an electrical outlet, however, the ease of inserting a plug in the outlet and/or removal of the plug from the outlet, is difficult and the structures are not particularly aesthetically pleasing. An additional safety feature of these prior art patents, is the positioning of the spring arms to generally overlie the apertures of each receptacle thereby making it difficult for a child to insert a straight object into the receptacle.

The present invention in contrast to the approach adopted in the prior art patents previously referred to, operates on a different principle, in that a post element is permanently secured to the wall receptacle and is adapted to releasably engage a separate cover member. The cover member has been adapted to allow plugs to be placed to the interior of the cover with the cords of the plugs passing out of the cover to the particular appliance. The cover engages the plug adjacent the back face of the plug and prevents removal of the plug as the cover is held in the locked position on the permanent member secured to the duplex receptacle.

According to a feature of the invention, the outer surface of the permanent member secured to the duplex receptacle includes a surface for locking with bias arms of the cover member, which can be engaged at a number of positions on the permanent member and locked therewith with removal of cover being possible by spreading the arms and withdrawing the cover member. In the preferred form, the permanent member has a number of teeth for engaging a cooperating surface of the bias arms.

According to a further feature of the invention, the permanent member which is secured to the duplex receptacle includes a projection which can be received within the ground aperture of one of the electrical outlets, which serves to lock the permanent member against rotation in the plane parallel to the face of the duplex receptacle. Securement of the permanent member is possible as a screw passes through the permanent member and is received within the central bolt receiving aperture provided in the duplex receptacle for securing of wall plates.

Preferred embodiments of the invention are shown in the drawings wherein.

Figure 1:
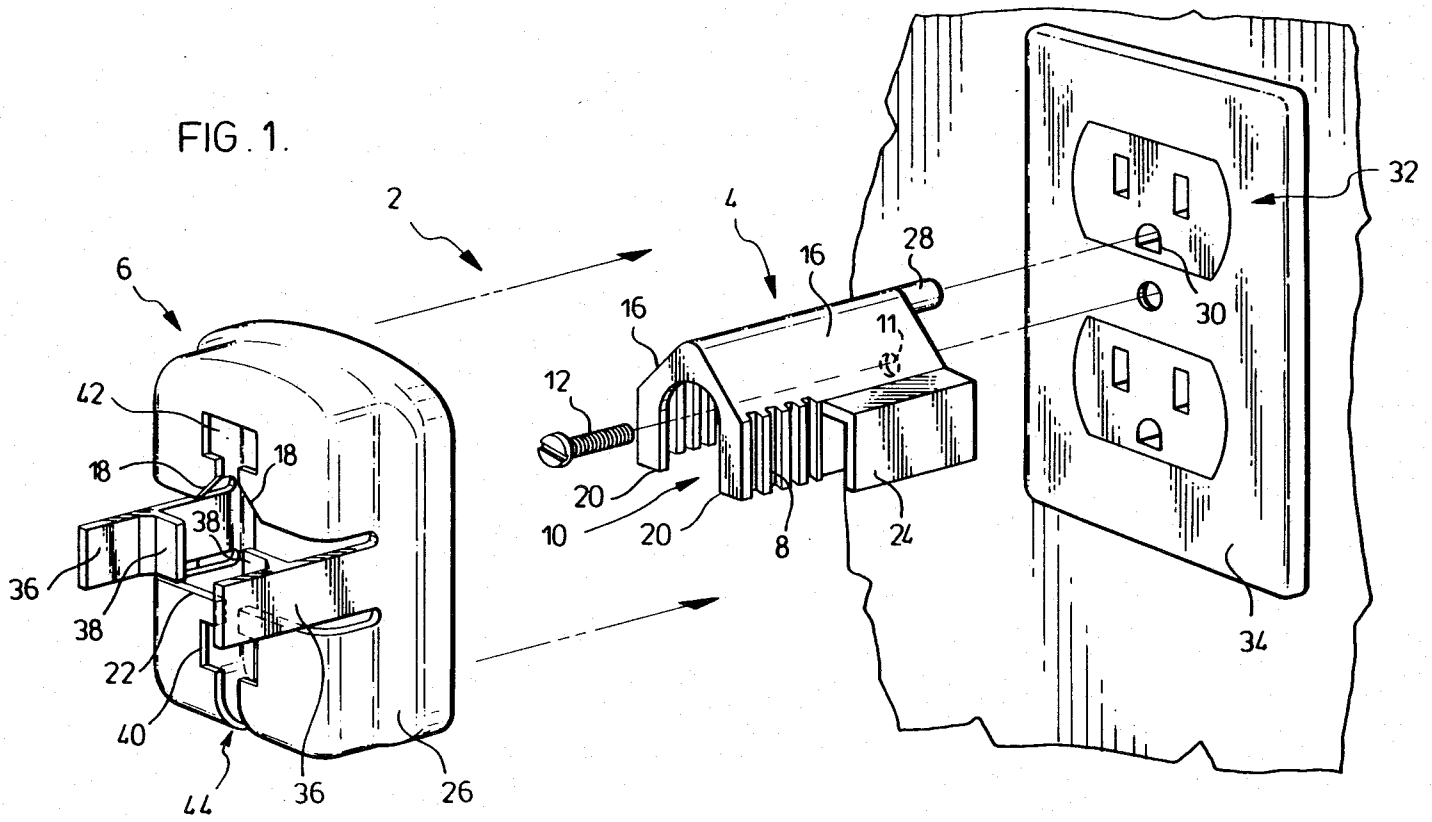
FIG. 1 is an exploded perspective view of the electrical wall plug accessory and an associated duplex receptacle.

The plug restraint device 2, has a securing post 4 adapted to be essentially permanently secured to the duplex receptacle generally shown as 32. The post is secured as screw 12 passes through aperture 11 in the back wall 14 of the post and is received within the central aperture of the duplex receptacle normally used for receiving the screw used to secure the face plate 34 to the receptacle. With locking projection 28, received within the female ground connector of the upper electrical outlet and with screw 12 secured within the receptacle, the securing post 4 is essentially permanently secured to the receptacle and maintains the face plate 34 in position. Once the post has been secured, the cover 6 may be inserted thereon and removed therefrom without requiring additional tools. This is accomplished as the arms 36 are forced outwardly as the inward projections 38 of the arms are forced over the tooth surface generally shown as 8 on the post 4. Therefore, the cover may be pushed over the post and the projections 38 will be forced over surface 8 and provide a lock therewith due to the biasing of the arms inwardly as the arms require some outward spreading to be forced over the post. Once secured, the cover cannot be inadvertently removed without spreading of the arms 36 causing the projections 38 to clear the tooth surface 8, whereby the cover is free to be removed.

The cover 6 includes a central aperture for allowing the post 4 to partially pass therethrough, and allow projections 38 to engage the tooth surface 8. The upper surface 16 of the post 4, cooperates with the complementary surfaces 18 of the cover, and the lower edges 20 of the post cooperates with edges 22 of a cover to lock the cover against rotation about the axis of the post 4. The cover 6 includes a slot 44 to allow the cords of the electrical plugs to pass through the cover. It can also be appreciated that the open central area which receives one end of the post 4, could be of a size to allow the plugs to be inserted therethrough, whereby the cord ports 40 and 42 would only have to be opened to the central opening. In this case for convenience, slot 44 has been provided which allows the cover to be inserted over each of the electrical cords. The securing post 4 includes outwardly located flanges 24 for engagement with the walls 26 of the cover to again generally fix the cover 6 so that it is not rotatable about the post 4. Flanges 24 are received interior to the cover and are adjacent the walls 26.

Figure 2:
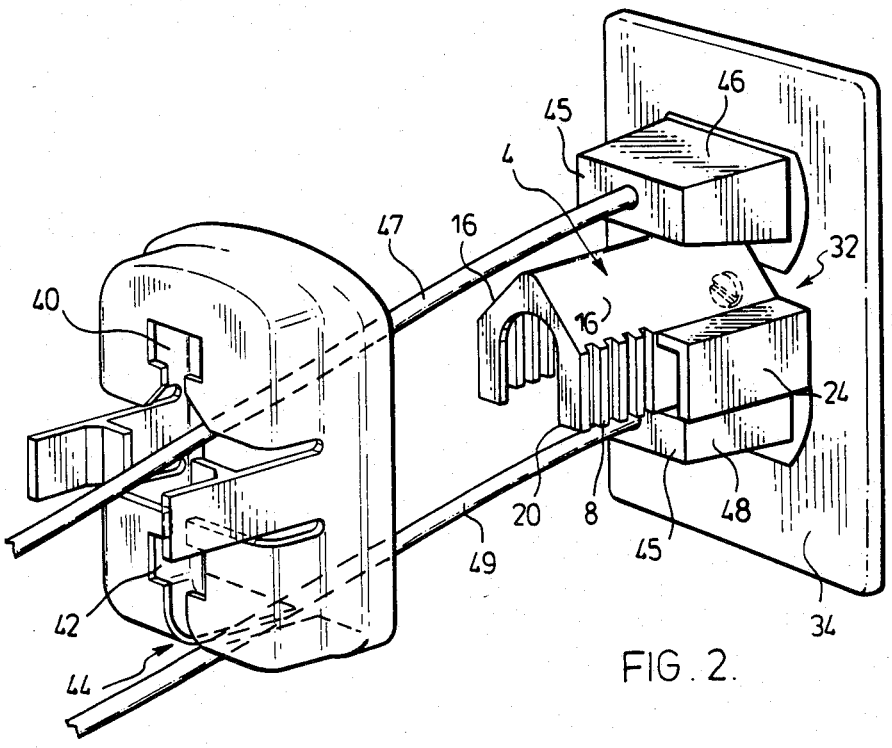
FIG. 2 is a perspective view of the accessory with one component thereof secured to the wall receptacle and the cover member in an non-engaged position.
Figure 3:
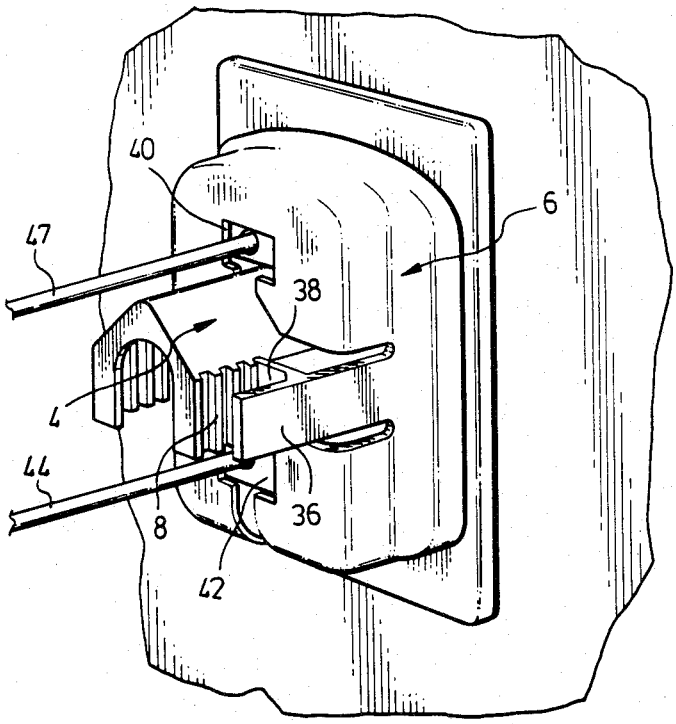
FIG. 3 shows the accessory with the cover in place on the permanent member.
Figure 5:
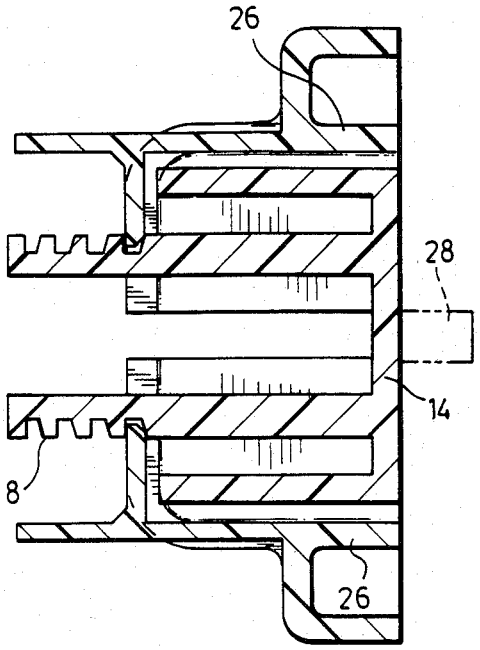
FIG. 5 is a view similar to the FIG. 4 with the cover in a fixed position relative to the permanent member.

As shown in FIG. 2, the securing post 4 has been secured to the duplex receptacle and two electrical plugs 46 and 48 have each been inserted within electrical sockets. The cords 47 and 49 of plugs 46 and 48 are positioned to allow passage thereof through cord ports 40 and 42 and cord 49 is shown passing through the slot 44 of the cover. The cover is shown in locked position on the securing post 4 in FIG. 3, and cord 47 and cord 49 are passing through cord ports 40 and 42 of the cover with the cover engaging the rear face 45 of each plug to hold the same in the received position relative to the duplex receptacle. The cover and the plugs may not be inadvertently removed as arms 36 are retaining projections 38 in locking engagement with the tooth surface 8. Details of this locking arrangement are clearly visible from the cross sectional view of FIG. 5.

Figure 4:
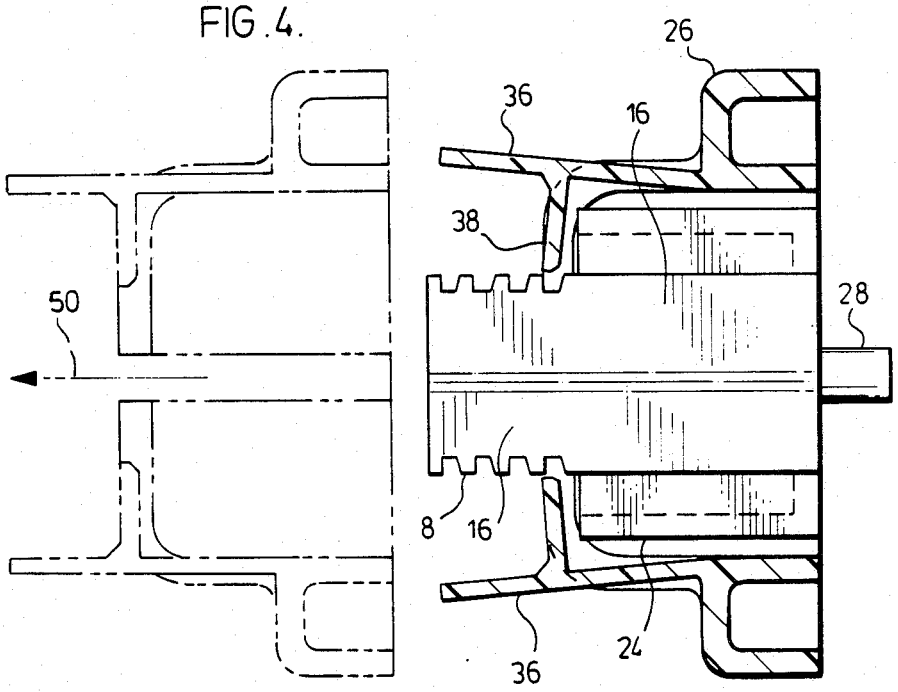
FIG. 4 is a cross sectional view through the accessory showing the preferred locking of the cover to the permanent member.

Removal of the cover from the securing post 4 is illustrated in FIG. 4. Here the arms 36 have been biased outwardly either by using two hands or using the thumb and the index finger of one hand to spread the arms such that the projections 38 are no longer in locking engagement with the tooth surface 8. Once these arms have been so positioned that cover may be slipped off the securing post in a direction generally indicated by arrow 50.

Figure 6:
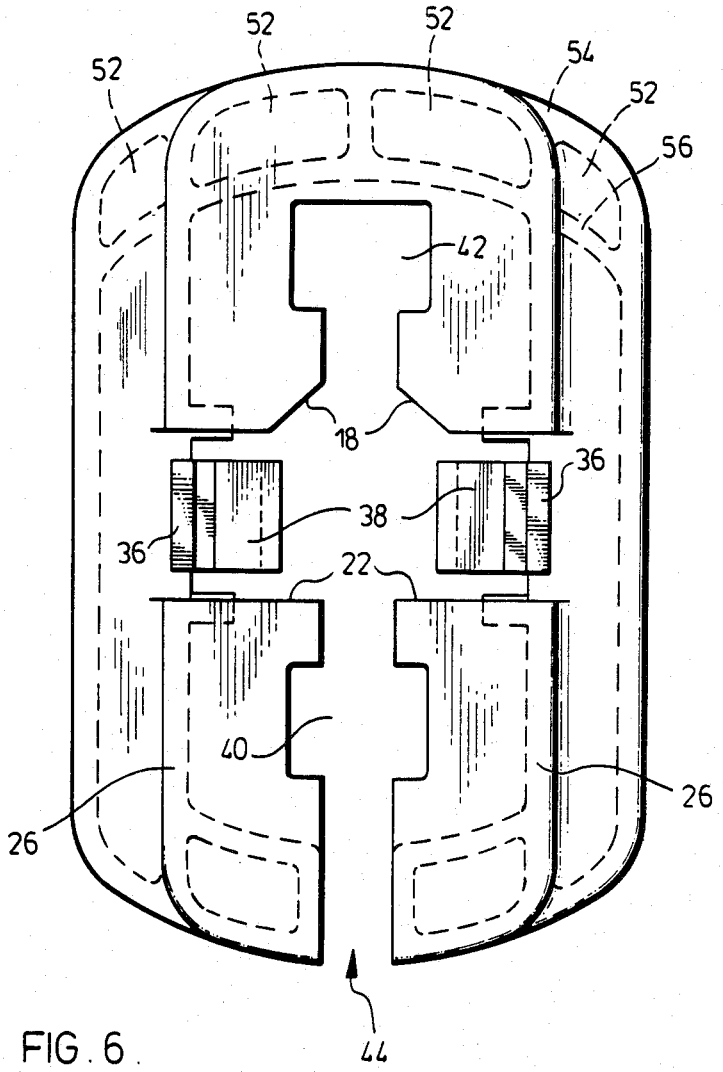
FIG. 6 is a front view of the cover member showing details of the interior ribbing used to increase the strength of the cover.

Further details of the cover member are illustrated in FIG. 6, where the upper area of the cover has been provided with a number of cell-like regions 52, defined between the peripheral wall 54 and the interior reinforcing rib 56. This upper region of the cover connects the left-hand side of the cover with the right-hand side of the cover and must carry any forces required to cause the outward biasing of arms 36. This area is prone to breakage and therefore has been reinforced in this simple manner. Such ribbing would be of reduced significance if the central area and the access therein was sized to allow the electrical plugs to be inserted therethrough rather than allowing the cover to be inserted over the electrical cords of the plugs to be retained by the cover.

The cover 6 and the securing post 4, can be made in various colours and are preferably made of a copolymer polypropylene or ABS material. These materials should have the appropriate fire rating required by the certifying body and meet or exceed the appropriate building codes. It can appreciated with this structure, the cover member 6 can be removed from the securing post 4 without requiring any tools.

The arms 36 which require outward biasing to allow removal of the cover, is an action which is not easily accomplished by a young child, as it requires a fair degree of dexterity and this device reduces the accessibility of the receptacle to the child.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. An electrical outlet accessory for restricting removal of electrical plugs from electrical receptacles comprising a securing post adapted for securement to a duplex receptacle, and a cover releasably securable to said securing post, said cover including access means therein to allow selective placement of up to two electrical plugs essentially within said cover with the associated electrical cord thereof passing through electrical cord ports in the cover, said cover being selectively engageable with said post at various positions to accomodate electrical plugs of different configuration and selectively disengageable from said post to allow plug removal from an insertion into such receptacle and wherein said securing post includes a projection to the rear face thereof for insertion in one of the ground connectors of such duplex receptacle.

2. An electrical outlet accessory as claimed in claim 1, wherein said cover includes a slot extending inwardly from an edge of said cover and connected to apertures in said cover.

3. An electrical outlet accessory as claimed in claim 1, wherein said securing post has an exterior surface of a shape defining a ratchet-type relationship with opposed arms of said cover biased to lock with the surface of said post and disengageable therefrom by forcing said arms apart to allow removal of said cover from said securing post.

4. An electrical outlet accessory as claimed in claim 3, wherein said securing post and said cover are made of an injection moldable plastic and said post is securable to the central threaded aperture normally used to secure a cover plate.

5. An electrical outlet accessory as claimed in claim 2, wherein said cover opposite said slot includes a reinforcing rib interior to said cover.

6. An electrical outlet accessory as claimed in claim 2, wherein said securing post to either side thereof includes cover engaging flange means which cooperates with stepped regions on either side of said cover to generally fix the cover in a non-pivotal relationship with said post when inserted thereon.

7. An electrical outlet accessory as claimed in claim 1, wherein said securing post is adapted for securement with the central aperture of a duplex receptacle used to secure a cover plate.

8. In combination, an electrical outlet accessory and a duplex electrical receptacle, said electrical outlet accessory restricting removal of electrical plugs from said electrical receptacle, said accessory comprising a securing post releasably secured to said duplex receptacle, and a cover having a central aperture therein for receiving said securing post, said cover including access means therein for allowing placement of up to two electrical plugs essentially within said cover one on either side of said central aperture with the associated electrical cord of each plug extending beyond the cover through apertures, said cover being selectively engageable with said post at various positions to accomodate electrical plugs of different configuration and selectively disengageable from said post without tools to allow removal or insertion of a plug from said receptacle and wherein said securing post includes a projection received in a ground connector of said duplex receptacle.

9. The combination as claimed in claim 8, wherein said cover includes a single slot extending inwardly from an edge of said cover and connected to said apertures in said cover.

10. An electrical outlet accessory for restricting removal of electrical plugs from electrical receptacles comprising a securing post adapted for securement to a duplex receptacle and a cover releasably securable to said securing post, said cover having a central aperture therein for receiving said securing post and allowing a portion of said securing post to pass therethrough, said cover including opposed arms on either side of said central aperture biased to engage with the surface of said post when said post is received in said central aperture, said arms including projections for cooperating with the surface of said post to lock said cover to said post when said post is engaged by said projections and movable to a disengaged position for removing said cover from said post without requiring tools, said cover being sized to receive therewithin an electrical plug on either side of said central aperture and including access means associated with said central aperture for allowing electrical cords of such electrical plugs to pass therethrough.

11. An accessory as claimed in claim 10, wherein said access means and said central aperture are interconnected.

* * * * *